US006945923B2

(12) United States Patent
Graber et al.

(10) Patent No.: US 6,945,923 B2
(45) Date of Patent: Sep. 20, 2005

(54) METHOD FOR PRODUCING A NEWSPAPER

(75) Inventors: Kurt Graber, Brittnau (CH); Jakob Gerhard, Brittnau (CH)

(73) Assignee: Hunkeler AG, Wikon (CH)

( * ) Notice: Subject to any disclaimer, the term of this patent is extended or adjusted under 35 U.S.C. 154(b) by 0 days.

(21) Appl. No.: 09/994,661

(22) Filed: Nov. 28, 2001

(65) Prior Publication Data

US 2002/0065184 A1 May 30, 2002

(30) Foreign Application Priority Data

Nov. 28, 2000 (EP) ..... 00126020

(51) Int. Cl.[7] ..... B31B 1/06

(52) U.S. Cl. ..... 493/401; 493/422; 493/416; 270/60; 270/52.25

(58) Field of Search ..... 493/413, 430, 493/416, 419, 420, 421, 480, 401, 422; 270/60, 50, 42, 49, 52.25

(56) References Cited

U.S. PATENT DOCUMENTS

| | | | | | |
|---|---|---|---|---|---|
| 2,107,462 | A | * | 2/1938 | Wise | 270/37 |
| 2,137,978 | A | * | 11/1938 | Thomas et al. | 270/37 |
| 2,361,140 | A | * | 10/1944 | Wolf | |
| 2,699,936 | A | * | 1/1955 | Dixon et al. | |
| 2,797,084 | A | * | 6/1957 | Hilgoe | 270/43 |
| 3,572,689 | A | * | 3/1971 | Murphy et al. | 493/423 |
| 3,580,562 | A | * | 5/1971 | Reist | 270/52.23 |
| 3,951,399 | A | * | 4/1976 | Reist | 270/52.2 |
| 4,073,486 | A | * | 2/1978 | Kober | |
| 4,076,231 | A | * | 2/1978 | Kutzner et al. | 493/342 |
| 4,190,242 | A | * | 2/1980 | Bolza-Schunemann | 270/50 |
| 4,279,409 | A | * | 7/1981 | Pemberton | |
| 4,635,915 | A | * | 1/1987 | Sato | 270/49 |
| 4,795,418 | A | * | 1/1989 | Reist | 493/422 |
| 4,863,152 | A | * | 9/1989 | Milo | 270/47 |
| 5,372,386 | A | * | 12/1994 | Mills | 283/67 |
| 5,813,568 | A | * | 9/1998 | Lowing | 221/6 |
| 6,139,003 | A | * | 10/2000 | Michalik et al. | 270/52.17 |
| 6,311,968 | B1 | * | 11/2001 | Linder et al. | 270/52.25 |

FOREIGN PATENT DOCUMENTS

| | | | |
|---|---|---|---|
| DE | 41 38 488 | A1 | 5/1993 |
| DE | 296 04 280 | U1 | 6/1996 |
| EP | 0 210 634 | * | 7/1986 |
| EP | A-1 219 556 | | 4/1987 |
| EP | 0 878 303 | A2 | 11/1998 |
| EP | 1 002751 | | 11/1998 |
| EP | 0 992 365 | A1 | 4/2000 |
| EP | 1 002 751 | A2 | 5/2000 |
| EP | 1 086 810 | A1 | 3/2001 |

OTHER PUBLICATIONS

Deutscher Drucker, pp. 45–46, Sep. 17, 1998.

* cited by examiner

*Primary Examiner*—Samah H. Tawfik
(74) *Attorney, Agent, or Firm*—Oliff & Berridge, PLC

(57) ABSTRACT

A method of producing a newspaper having at least one section which is formed from at least one centrally folded printed sheet. The following steps are carried out according to the invention: a) individual sequentially printed sheets, which are intended for forming the individual sections of the newspaper, are fed continuously to a first collecting station, and sheets which are assigned to one common section are positioned one above the other (collected) to form a sheet stack; b) a finished sheet stack is conveyed away from the first collecting station, a first sheet of a further section being fed to the first collecting station while the preceding sheet stack is being conveyed away from the first collecting station or once it has been conveyed away therefrom; c) the finished sheet stack is folded in order to produce a section; d) the section is deposited in a second collecting station such that it comes to rest on, if appropriate, an already deposited section; e) the steps a) to d) are repeated, if appropriate, until all the sections of the newspaper have been completed and positioned one upon the other to form a section stack.

16 Claims, 2 Drawing Sheets

METHOD FOR PRODUCING A NEWSPAPER

BACKGROUND OF THE INVENTION

1. Field of Invention

The invention relates to a method of producing a newspaper.

2. Description of Related Art

A classic newspaper is typically composed of a plurality of sections which are positioned one inside the other, are folded once in the center all together and, in turn, comprise individual sheets which are positioned one upon the other and folded one inside the other. A section, also referred to as a bundle, typically contains from two to ten sheets, depending on the amount of printing. A section may also contain half-sheets which are not folded to produce the section. The newspaper is formed from a plurality of sections which are again folded one inside the other. In the case of a typical daily newspaper, for example the outermost, first section contains the front page and the international part, the second section contains the regional part, the third section contains the financial part, etc. The reader finds all the sections in the correct order when he/she opens up the newspaper for the first time. The individual sheets or pages are likewise arranged in the correct order when the sections are opened up. The known, always identical basic composition of a certain newspaper makes it possible for the regular reader to find quickly the parts which interest him/her.

In exceptional cases, it is also possible for the newspaper to comprise just one section. This section comprises, for example, a plurality of sheets which are folded one inside the other twice.

In the case of conventional printing methods for producing a newspaper, for example letter press printing, offset printing and gravure printing, a rotary printing machine is used for one or more paper webs to be printed at the same time in a plurality of printing units and to be folded to form the end product or newspaper. This printing method is static in the sense that a certain number of identical newspapers are printed by first of all all of the first, second and further pages being printed and, following completion of the printing, being joined together to form a section or to form a complete newspaper. In order to print a product with different contents, the printing machine is stopped, the printing formes, e.g. plates, blocks, cylinders, are changed and the printing machine is restarted.

Such static printing methods are only economically viable for very large print jobs. For this reason, even national daily newspapers are printed in only one center or in a small number of centers and distributed from there, it often being the case that long distances have to be covered precisely when the newspapers are shipped abroad. The topicality of the newspaper contents suffers as a result of the transporting time necessary for this purpose. The transportation itself involves high outlay in terms of personnel and energy.

Digital printing machines, e.g. laser printers or ink-jet printers, in which a plurality of different pages can be printed sequentially, i.e. one after the other, without the printing machine having to be stopped (dynamic printing method), are known. Digital printing machines are used, at present, to produce end products with an end format of typically DIN A4 and less, said end products comprising a plurality of sheets which are not folded or are folded once and, once printing has been completed are collected and connected to one another, e.g. by wire stapling or gluing.

Previously known digitally printed products are not comparable in terms of their composition and appearance, with the current, conventionally produced newspapers.

SUMMARY OF THE INVENTION

The object of the invention is to specify a method of producing a newspaper which can be implemented straightforwardly and cost-effectively, even in a decentralized manner, and in the case of which the newspaper does not differ in appearance from a conventionally printed newspaper. The intention is also to specify an apparatus for implementing the method.

The invention is achieved by a method of producing a newspaper having the claimed invention, and also by an apparatus for implementing the method having the claimed invention. Advantageous developments of the method and of the apparatus are described in the dependent claims, the description and the drawing.

In the case of the method according to the invention, the sheets printed in a digital printing machine are processed to form a newspaper in one operation in that the sheets belonging to a newspaper or a section, which are printed in sequence one after the other, are collected and formed into a section by being folded one inside the other, and further sections are printed in sequence, collected, folded and formed into a newspaper by all the sections being folded one inside the other again. The newspaper is produced according to the invention in the following steps: the continuously printed sheets are fed continuously one by one to a first collecting station. Sheets which are assigned to one common section are positioned one above the other (collected) to form a sheet stack or a not yet folded section. Once all of the sheets of a section have been collected, the finished sheet stack is conveyed away from the first collector station. In this case, a first sheet of a further section, which is continuously produced by the printing machine and supplied to the collecting station, is fed to the collecting station while the preceding sheet stack is conveyed away from the first collecting station or once it has been conveyed away therefrom. It is thus possible for the printing machine to run continuously without interruption. A finished sheet stack or a section which is finished apart from the center fold is then folded in the center in order to complete the section. The section is deposited in a second collecting station such that it comes to rest on an, if appropriate, already deposited section which is assigned to the same newspaper. The steps of feeding, collecting, conveying away and folding are repeated, if appropriate, until all the sections of the newspaper have been completed and positioned one upon the other to form a section stack. This section stack is then preferably folded in the center again. The method is preferably continued without interruption with the production of the next newspaper.

It is advantageous for sheets which are intended for forming individual sections of a newspaper to be printed sequentially by a digital printing machine in a previous method step. Sequentially means that, first of all, all of the sheets which form a copy of a newspaper are printed one after the other, each sheet bearing different printing. Thereafter, the sheets for the next newspaper copy are printed. This is not possible using conventional printing machines.

The invention makes it possible to print just the precise number of complete newspapers in the typical newspaper format as has to be available at the printing location. The expensive operation of exchanging printing formes is done away with altogether if a digital printer is used; the printed contents are changed electronically. It is also the case here, in contrast to known static printing methods, that it is not necessary to keep any supply of printed pages between the individual printing operations. All the sheets of a complete newspaper are preferably printed one after the other, and the sheets of a further newspaper are printed thereafter, etc. It is also possible for one or more sections to be printed beforehand and for the newspaper only to be completed just prior to distribution by virtue of the as yet absent sections with topical and/or local information being printed.

An apparatus according to the invention for implementing the method has a first collecting station which is intended for collecting sheets and comprises a feed and depositing apparatus, for feeding individual sheets and depositing the same to form a sheet stack, and a removal apparatus for conveying sheet stacks away. A digital printing machine for the sequential printing of sheets intended for forming the newspaper, a first folding arrangement for folding a finished sheet stack, a second collecting station for collecting complete sections, and a second folding arrangement for folding the complete newspaper are preferably provided. The correct method sequence is preferably controlled, by means of software, by a control unit or by timing marks.

On account of a digital printing machine being used, the apparatus is more cost-effective and straightforward to operate and to maintain than a conventional set-up for producing newspapers using a conventional printing machine. The amount of space required is also reduced. It is thus possible, instead of using a central set-up, for a number of such apparatuses with the corresponding printing machines to be decentralized, the distribution-related distances being shortened as a result. The printed contents can be transferred electronically to the production sites. It is also possible, in principle, for a newspaper only to be produced in accordance with actual demand. It is further possible for the newspaper to be put together in a customer-specific manner, e.g. for certain sections to be left out or to be included in a locality-specific manner.

In an advantageous development of the method, at least one further printed product, e.g. a prefabricated section or a prefabricated advertising supplement, is fed to the second collecting station by a feed arrangement and positioned on a section deposited there. The point in time at which the further printed product is deposited is preferably selected such that it comes to rest on a predetermined section, if appropriate at a predetermined location of the section. It is thus possible for the position of a supplement within the newspaper to be adapted thematically to the section contents.

A further advantage of the invention is that it is easily possible to produce sections which optionally comprise whole sheets and half-sheets. The digital printing machine and the following cross-cutters are capable of producing different sheet lengths dynamically. The first collecting apparatus according to the invention is configured such that it is possible, in any desired sequence, for both whole sheets and half-sheets to be collected in a disruption-free manner and stacked with straight edges. For example, suckers or grippers grip the fed sheets along the entire width of the leading sheet edge, as seen in the conveying direction, with the result that even a half-sheet is transported and deposited in a precisely aligned manner.

BRIEF DESCRIPTION OF THE DRAWINGS

An example of the invention is described hereinbelow and illustrated in the drawing, in which, purely schematically.

DETAILED DESCRIPTION OF PREFERRED EMBODIMENTS

Figure 1:
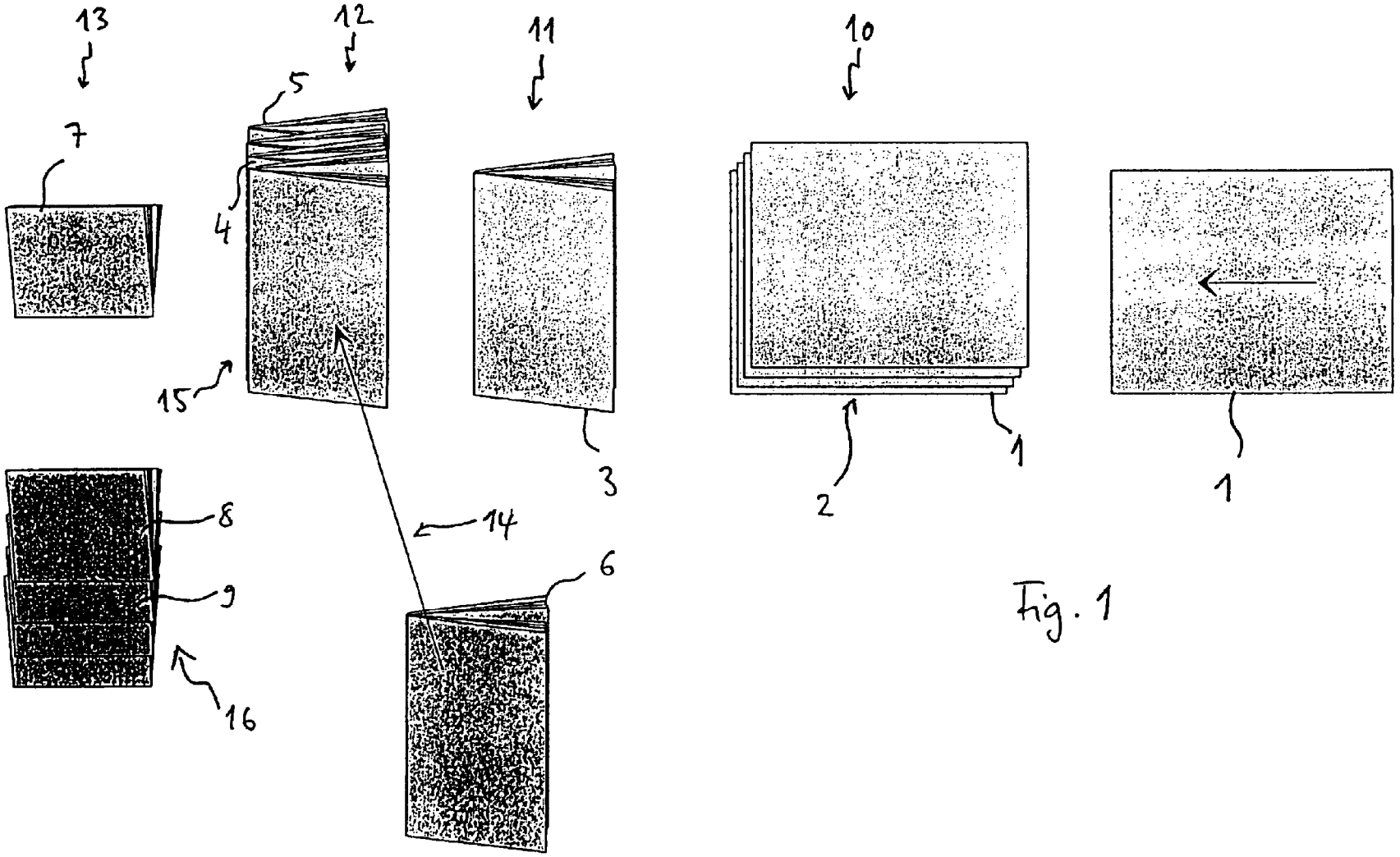
FIG. 1 shows the sequence of the method according to the invention.

Individual sheets 1 are printed in a digital printing machine, sheet-fed or web-fed printing machine (not shown here), cross-cut if appropriate and collected in a first collecting station 10 to form a sheet stack 2 made of individual sheets 1. It is possible for printing to take place both in the forward direction, from A to Z, or in the rearward direction, from Z to A. In the first collector station 10, the sheets 1 are received, transported and deposited precisely one upon the other. The finished sheet stack 2 is folded in a first folding arrangement 11 to form a section 3. The section 3 is positioned, in a second collecting station 12, on a section stack 15 comprising already printed and folded sections 4, 5. A feed arrangement 14 for supplements may be used to position a previously produced supplement 6 at a predetermined location on one of the sections 3, 4, 5 in the second collecting station 12. Once all of the sections 3, 4, 5 of a newspaper 7 have been collected, the section stack 15 is folded in the center in a second folding station 13. The thus completed newspapers 7, 8, 9 are deposited in an ordered manner, e.g. in an imbricated formation or on a stack, and transported away by a removal arrangement 16.

Figure 2:
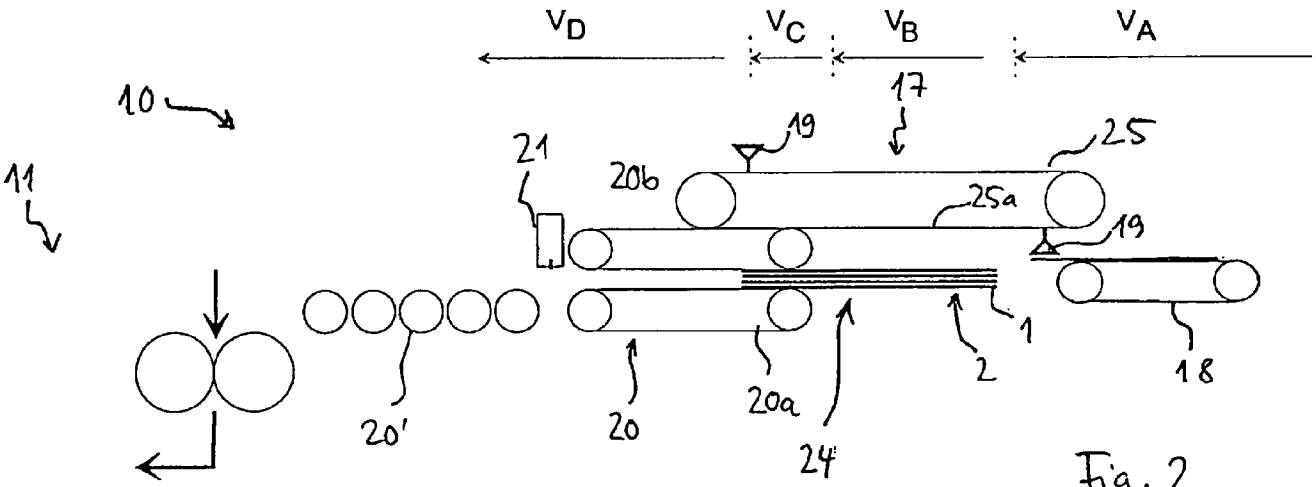
FIG. 2 shows a side view of a first collection station.

FIG. 2 shows an example of a first collecting station 10 according to the invention with a following folding station 11. The first collecting station 10 is suitable specifically for large-format digital printing and is made up of a feed and depositing apparatus 17, for feeding the individual sheets 1 and depositing them to form a sheet stack 2, and of a removal apparatus 20 for quickly transporting a finished sheet stack 2 away to the following operating process, i.e. to the folding station 11, without the individual sheets 1 in the sheet stack 2 being displaced in relation to one another.

A transporting system 17 with suitable receiving elements 19, e.g. grippers or suckers, receives individual sheets 1 from the previous process, e.g. the printing machine or the cross-cutters, and guides the sheets 1 into a first depositing position 24. In this case, the speed of the sheet 1 in the first collecting station 10 is not uniform: the receiving element 19, which moves along a continuous circulatory path 25, rectilinear at least in one segment 25*a*, initially runs at a speed $v_A$ which is essentially identical to that of the previous process. Depending on the printing system $v_A$ is between 50 and 150 m/min, preferably between 50 and 80 m/min. An incoming sheet 1 is thus received by the receiving elements 19 at approximately the same speed. Once it has left the previous process, the sheet is accelerated to a speed $v_B$, in order to acquire a lead over the following sheet. $v_B$ is approximately two to three times the speed $v_A$, preferably between 150 and 200 m/min. Finally, the sheet is deposited in the depositing position 24 at reduced speed $v_C$, in order for the sheet 1 to be deposited carefully, and in the correct position, without the edges of the thin paper of the newspaper being damaged in the process. $v_C$ is preferably from approximately 120 to 150 m/min. The variable conveying speed makes it possible for large sheets, typically in a format of larger than DIN A 2 (width typically between 420 and 508 mm; length between 580 and 760 mm), of thin newspaper paper to be transported quickly, but carefully, and to be stacked with accurate edge alignment. The non-uniform speed of the receiving element 19 along its circulatory path can be realized, for example, by a servo drive.

A plurality of sheets 1 positioned one upon the other form a sheet stack 2. For transporting the latter away into the following operating process, i.e. into the first folding station 11, the finished sheet stack 2 is transported away from the first collecting station 10 immediately after the last sheet 1 of a sheet stack 2 has arrived. The transporting-away speed here is preferably higher than the previously described speed $v_A$, in order that the first-arriving sheet of a further sheet stack and the outgoing sheet stack do not disrupt one another in the first collecting station 10. A removal arrangement 20 transports the entire sheet stack out of the first collecting apparatus 10 at a speed $v_D$. The removal arrangement 20 here comprises two transporting belts or conveying belts 20*a*, 20*b*, which form between them a gap for receiving the sheet stack 2. Alternatively, it is also possible to use grippers. Immediately before the transportation by the removal arrangement 20, 20', or during said transportation, the individual sheets 1 of the sheet stack 2 are preferably connected to one another temporarily in order that they cannot be displaced during the transportation to the folding station 11. This temporary connection preferably takes place by electrostatic charging by means of a charging apparatus 21. The charging is dissipated again in an extremely short period of time during or after the folding operation. It is alternatively possible, for being transported together, for all the sheets of a sheet stack to be pierced by needles ("crimping"). In order for the sheet stack to be transferred to the following folding unit without the sheets being displaced in relation to one another, the first folding station 11 is preferably arranged directly at the outlet of the first collecting station 10. Alternatively, it is also possible for the folding station 11 to be integrated in the first collecting station 10, preferably by the entire sheet stack located in the depositing position 24 being folded directly in situ by a knife folding arrangement, arranged centrally in relation to the sheet stack, and thereby also conveyed out of the depositing position 24, e.g. in the downward or upward direction.

The first folding station 11 comprises, for example, a buckle, vacuum or knife folding unit, it also being possible for the first two units to be integrated in the first collecting station 10. In this case, the collected sheets are folded for the first time in the first collecting station 10 and leave the first collecting station 10 in the folded state.

Figure 3:
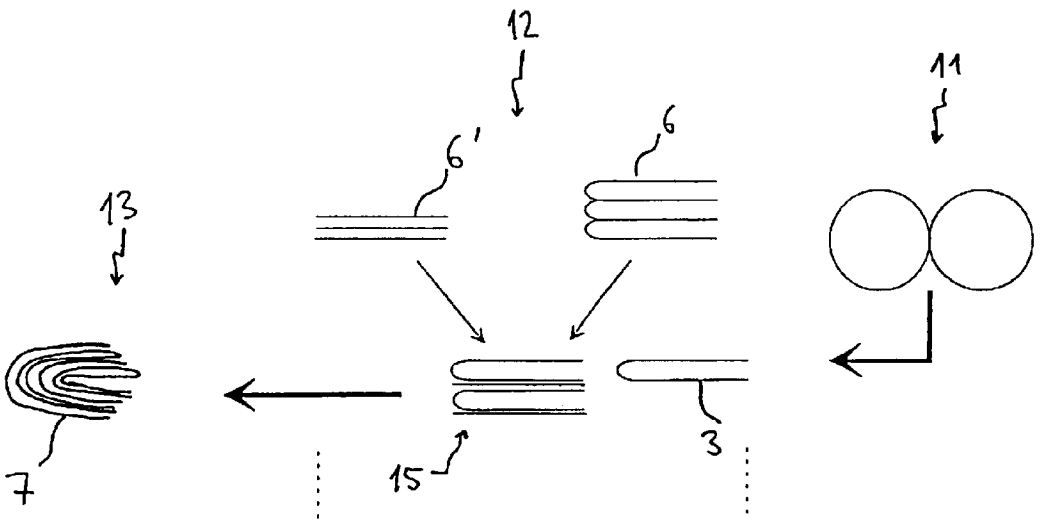
FIG. 3 shows the sequence of the method according to the invention in the region of the second collecting station.

FIG. 3 shows the sequence of a method according to the invention in the region of the second collecting station 12. Sections 3 coming from the first folding apparatus 11 are deposited on a section stack 15 in the second collecting station 12. Prefabricated supplements 6, 6', which are present as individual sheets or likewise in the form of sections, e.g. previously printed sections or advertising literature, may be supplied to the section stack 15 in a controlled manner. The finished section stack 15 comprises all the sections 3, 4, 5 of the newspaper and all the supplements 6, 6' envisaged therefor. In a second folding apparatus 13, it is folded once in the center in a direction perpendicular to the folds of the individual sections 3, 4, 5. The finished newspaper 7 may then be transported away.

What is claimed is:

1. A method of producing a newspaper having at least two sections, each section being formed from at least two centrally folded printed sheets, the method comprising:

a) printing sheets which form a copy of the sections of the newspaper sequentially one after the other by using a digital printing machine, each of the sheets bears a different printing;

b) feeding the sheets, that belong to a first one of said sections of the newspaper, continuously one by one to a first collecting station;

c) positioning the sheets, that belong to said first section of the newspaper, one above the other to form a first sheet stack;

d) conveying away the first sheet stack from the first collecting station;

e) folding the first sheet stack in order to produce the first section;

f) depositing the folded first section on a second collecting station;

g) feeding the sheets, that belong to a second one of said sections of the newspaper, continuously one by one to the first collecting station, the first sheet of the second section being fed to the first collection station after the preceding sheet stack has been conveyed away from the first collection station;

h) positioning the sheets, that belong to said second section of the newspaper, one above the other to form a second sheet stack;

i) conveying away the second sheet stack from the first collecting station;

k) folding the second sheet sack in order to produce the second section;

l) depositing the folded second section on the second collecting station such that it comes to rest on the already deposited first section; and m) repeating steps g) to l) until all the sections of the newspaper have been completed and positioned one upon the other to form a section stack, wherein the section stack is folded in the center to form a newspaper consisting of at least two folded sections.

2. The method as claimed in claim 1, wherein the sheets of the sheet stack are releaseably connected to one another in order to be conveyed away.

3. The method as claimed in claim 1, wherein at least one further printed product is fed to the second collecting station which is positioned and deposited on the section.

4. The method as claimed in claim 3, wherein the at least one further printed product is fed such that it comes to rest on a predetermined section.

5. The method as claimed in claim 1, wherein the sheets of a width of from 420 to 508 cm and of a length of from 580 to 760 cm are processed.

6. The method as claimed in claim 1, wherein the sheet stack is conveyed away from the first collecting station at a speed which is greater than the speed of the sheets fed to the first collecting station.

7. The method as claimed in claim 1, wherein the sheet is braked to a reduced speed before being deposited in the first collecting station.

8. The method as claimed in claim 1, wherein the step of conveying away the sheet stack from the first collecting station conveys a velocity in the first collecting station that is not uniform but corresponds, in a first section, to a velocity of a previous speed $v_A$, then accelerated to a speed $v_B$, and then reduced to a speed $v_C$ prior to depositing the sheet in the first collecting station.

9. A method of producing a newspaper having at least two sections, each section being formed from at least one centrally folded printed sheet, the method comprising:

a) printing sheets which form a copy of the sections of the newspaper sequentially one after the other by using a digital printing machine, each of the sheets bears a different printing;

b) feeding the sheets, that belong to a first one of said sections of the newspaper, continuously one by one to a first collecting station;

c) positioning the sheets, that belong to said first section of the newspaper, one above the other to form a first sheet stack;

d) conveying away the first sheet stack from the first collecting station;

e) folding the first sheet stack in order to produce the first section;

f) depositing the folded first section on a second collecting station;

g) feeding the sheets, that belong to a second one of said sections of the newspaper, continuously one by one to the first collecting station, the first sheet of the second section being fed to the first collection station after the preceding sheet stack has been conveyed away from the first collection station;

h) positioning the sheets, that belong to said second section of the newspaper, one above the other to form a second sheet stack;

i) conveying away the second sheet stack from the first collecting station;

k) folding the second sheet stack in order to produce the second section;

l) depositing the folded second section on the second collecting station such that it comes to rest on the already deposited first section; and m) repeating steps g) to l) until all the sections of the newspaper have been completed and positioned one upon the other to form a section stack, wherein the section stack is folded in the center to form a newspaper consisting of at least two folded sections.

10. The method as claimed in claim 9, wherein the sheets of the sheet stack are releaseably connected to one another in order to be conveyed away.

11. The method as claimed in claim 9, wherein at least one further printed product is fed to the second collecting station which is positioned and deposited on the section.

12. The method as claimed in claim 11, wherein the at least one further printed product is fed such that it comes to rest on a predetermined section.

13. The method as claimed in claim 9, wherein the sheets of a width of from 420 to 508 cm and of a length of from 580 to 760 cm are processed.

14. The method as claimed in claim 9, wherein the sheet stack is conveyed away from the first collecting station at a speed which is greater than the speed of the sheets fed to the first collecting station.

15. The method as claimed in claim 9, wherein the sheet is braked to a reduced speed before being deposited in the first collecting station.

16. The method as claimed in claim 9, wherein the step of conveying away the sheet stack from the first collecting station conveys a velocity in the first collecting station that is not uniform but corresponds, in a first section, to a velocity of a previous speed $v_A$, then accelerated to a speed $v_B$, and then reduced to a speed $v_C$ prior to depositing the sheet in the first collecting station.

* * * * *